US006539926B2

(12) United States Patent
Hakansson et al.

(10) Patent No.: US 6,539,926 B2
(45) Date of Patent: Apr. 1, 2003

(54) FUEL DELIVERY SYSTEM

(75) Inventors: Nils-Olof Hakansson, Stenkullen (SE); Jan Lindblom, Lycke (SE)

(73) Assignee: Volvo Lastvagner AB, Göteborg (SE)

( * ) Notice: Subject to any disclaimer, the term of this patent is extended or adjusted under 35 U.S.C. 154(b) by 0 days.

(21) Appl. No.: 09/681,626

(22) Filed: May 11, 2001

(65) Prior Publication Data

US 2001/0042540 A1 Nov. 22, 2001

Related U.S. Application Data

(63) Continuation of application No. PCT/SE99/02041, filed on Nov. 10, 1999.

(30) Foreign Application Priority Data

Nov. 12, 1998 (SE) ..... 9803864

(51) Int. Cl.[7] ..... F02M 59/12; F02M 37/04
(52) U.S. Cl. ..... 123/495; 123/497; 417/420
(58) Field of Search ..... 123/497, 456, 123/506, 446, 514; 417/214, 420, 410

(56) References Cited

U.S. PATENT DOCUMENTS 2,779,513 A 1/1957 Dickey
3,670,924 A * 6/1972 Asper ..... 222/2
3,716,306 A 2/1973 Martin, Sr. et al.
4,065,235 A 12/1977 Furlong et al.
4,111,614 A 9/1978 Martin et al.
4,846,641 A 7/1989 Pieters et al.
5,507,266 A * 4/1996 Wright et al. ..... 123/497
5,540,206 A * 7/1996 Heimberg ..... 123/497
5,702,234 A 12/1997 Pieters
5,779,456 A 7/1998 Bowes et al.
6,058,912 A * 5/2000 Rembold et al. ..... 123/516
6,102,010 A * 8/2000 Isozumi et al. ..... 123/506

* cited by examiner

*Primary Examiner*—Carl S. Miller
(74) *Attorney, Agent, or Firm*—Howrey, Simon, Arnold & White LLP

(57) ABSTRACT

A fuel delivery system having a fuel reservoir connected to a suction side of a pump, a fuel delivery line connected to an output side of the pump, a number of fuel injectors connected to the delivery line, and a return line from the injectors to the suction side of the pump. The pump has a housing, a pumping chamber within the housing, a driver rotor and a driven rotor within the pumping chamber, and an input shaft t the housing. The input shaft is arranged such that rotation of the input shaft effects rotation of the driver rotor. The driver rotor is caused to rotate by the input shaft via a magnetic coupling. The magnetic coupling is arranged to slip when a predetermined value of torque is applied across the coupling such that a maximum pressure value of about 12 bar is attained at the output side of the pump.

6 Claims, 3 Drawing Sheets

FUEL DELIVERY SYSTEM

CROSS REFERENCE TO RELATED APPLICATIONS

The present application is a continuation of International Application No. PCT/SE99/02041, filed Nov. 10, 1999 and published in English pursuant to PCT Article 21(2), now abandoned, and which claims priority to Swedish Application No. 9803864-6, filed Nov. 12, 1998. The disclosures of both applications are expressly incorporated herein by reference in their entirety.

BACKGROUND OF INVENTION

Technical Field.

The present invention relates to a fuel delivery system according to the preamble of claim 1.

Background Information.

In the fuel delivery system of a commercial vehicle it is known to use a rotary displacement pump driven by the transmission of the vehicle to increase the fuel pressure in the system to a level suitable for injection of the fuel into the vehicle engine. The pump has to be capable of delivering fuel at a sufficient pressure substantially immediately upon starting the engine. This implies that at high engine speeds the pressure in the fuel delivery system is greater than actually required. Consequently, a pressure relief valve is required downstream of the pump to relieve the excess pressure. Should the pressure relief valve stick in a partially or fully closed position, there is a risk that the pressure in the fuel delivery system will become dangerously high, possibly resulting in rupture of a seal or fuel line.

A conventional rotary displacement pump comprises a housing, a pumping chamber within the housing, a driver rotor and a driven rotor within the pumping chamber, and an input shaft to the housing. The input shaft is connected to the driver rotor to effect rotation of the driver rotor. To prevent leakage of the pumped liquid from the pumping chamber, it is necessary that an adequate sealing means be provided between the housing and the input shaft. Due to the rotation of the input shaft, a dynamic seal must be employed. In the fuel delivery system described above, failure of the sealing means not only implies that fuel leaks out of the system, but also that the leaking fuel may migrate into the transmission and mix with the lubricant therein.

A fuel pump disclosed in U.S. Pat. No. 2,779,513 is driven by a power source via a magnetic coupling. A permanent impervious closure seals the pump from the power source, thereby reducing the risk of leakage. A spring pressed relief valve is provided downstream of the pump whereby fuel from the pump not consumed by a device, such as an internal combustion engine, is permitted to return back to the fuel tank.

SUMMARY OF INVENTION

It is an object of the present invention to provide a fuel delivery system suitable for use in a vehicle, with the system being more energy-efficient than conventional systems while less reliant on the necessity of a functioning pressure relief valve.

This object is achieved in accordance with the present invention by a fuel delivery system comprising a fuel reservoir connected to a suction side of a pump, a fuel delivery line connected to an output side of the pump, a number of fuel injectors connected to the delivery line, and a return line from the injectors to the suction side of the pump. The pump comprises a housing, a pumping chamber within the housing, a driver rotor and a driven rotor within the pumping chamber, and an input shaft to the housing, the input shaft being arranged such that rotation of said input shaft effects rotation of the driver rotor. The driver rotor is caused to rotate by the input shaft via a magnetic coupling. The magnetic coupling is arranged to slip when a predetermined value of torque is applied across the coupling such that a preferred maximum pressure value of about 12 bar is attained at the output side of said pump.

Since the magnetic coupling is only capable of transmitting a predetermined value of torque, the pressure downstream of the pump cannot exceed a predetermined value, irrespective of the rotational speed and/or torque of the input shaft.

In a preferred embodiment of the invention, the system further comprises a pressure relief valve in the fuel delivery line, the pressure relief valve being arranged to reduce the pressure in the fuel delivery line to about 6 bar.

Further preferred embodiments of the invention are detailed in the dependent claims.

BRIEF DESCRIPTION OF DRAWINGS

The invention will be described in greater detail in the following by way of example only and with reference to embodiments shown in the attached drawings, in which.

DETAILED DESCRIPTION

Figure 1:
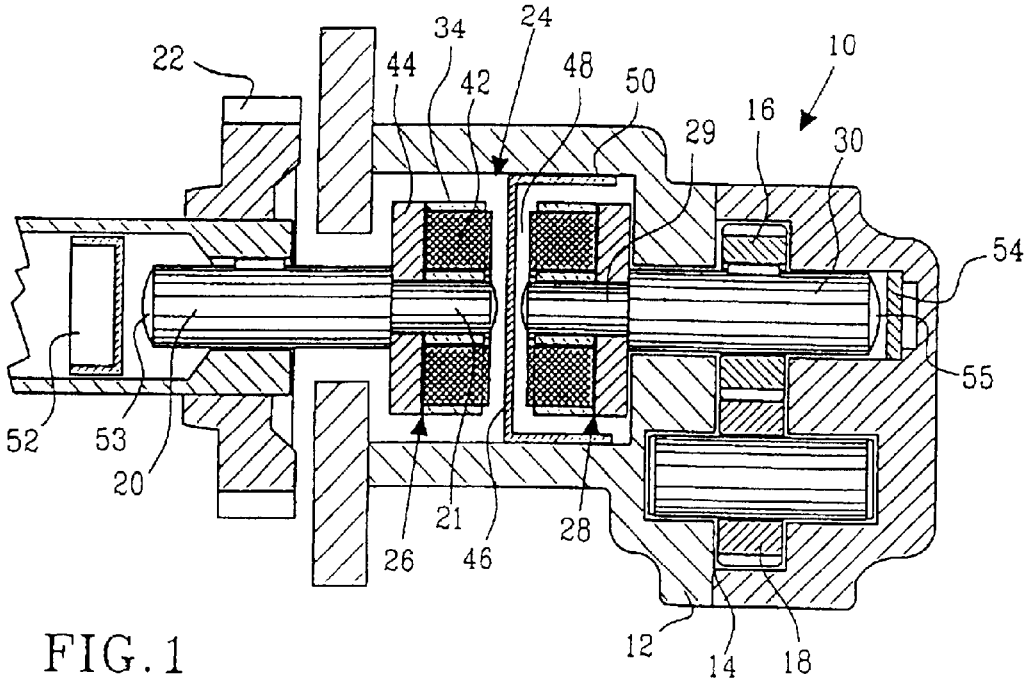
FIG. 1 is a schematic cross-sectional view of an embodiment of a rotary displacement pump for use in the fuel delivery system according to the present invention.

In the drawings, reference numeral 10 generally denotes a rotary displacement pump for use in a fuel delivery system according to the present invention. The pump comprises a housing 12 within which a pumping chamber 14 is arranged.

Conventionally, the pumping chamber accommodates a driver rotor 16 and a driven rotor 18. As illustrated, the driver rotor 16 and the driven rotor 18 are gear wheels, though it is to be understood that any intermeshing rotary displacement means may be employed. The pump 10 further comprises an input shaft 20 for causing rotation of the driver rotor 16. The input shaft 20 may be driven by a gear wheel 22, pulley or any other suitable means. The driver rotor 16 is rotated by the input shaft 20 via a magnetic coupling, generally denoted by reference numeral 24. In accordance with the present invention, and as will be explained in greater detail below, the magnetic coupling is arranged such that when a predetermined value of torque is applied across the coupling, the coupling slips thereby restricting the amount of torque transmission through the coupling.

Figure 2:
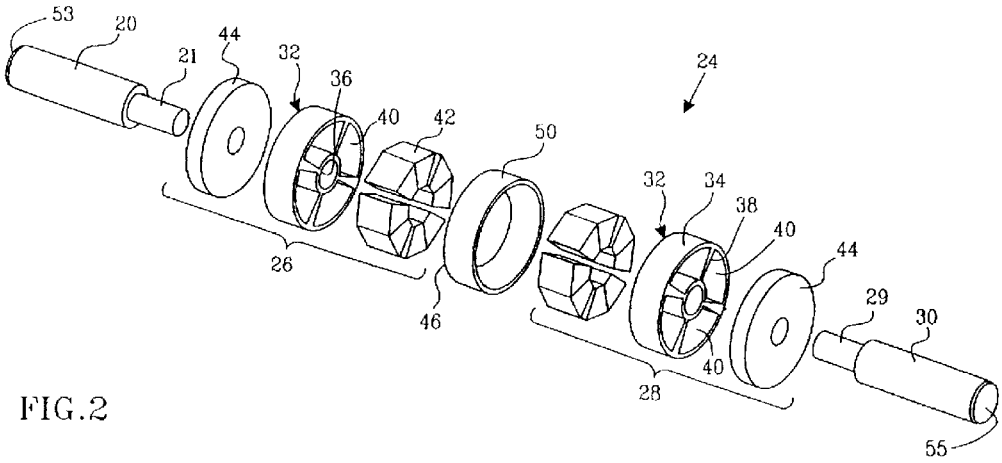
FIG. 2 is an exploded perspective view of a magnetic coupling used in the pump of FIG. 1.

As is most clearly seen from FIG. 2, the magnetic coupling 24 comprises a first magnet holder assembly 26 attached to the input shaft 20, for example by a press fit, and a second magnet holder assembly 28 attached to a carrier shaft 30 carrying the driver rotor 16 (not shown in FIG. 2). Each magnet holder assembly comprises an annular magnet holder 32 made from a non-magnetic material, preferably aluminum. Each holder 32 has a peripheral wall 34, an inner wall 36 and a number of dividing walls 38. The dividing walls 38 extend radially from the inner wall 36 to the outer wall 34 to define a number of compartments 40. Each compartment is adapted to house one or more magnets, preferably a pair of magnets 42. In the illustrated embodiment, each holder has four dividing walls 38 thereby forming four compartments 40. It should be understood, however, that the invention can be realized using holders having any number of a plurality of compartments.

Each magnet holder assembly 26, 28 further comprises a backing plate 44 of magnetic material such as steel, to which each pair of magnets 42 is adhered.

The first and second magnet holder assemblies 26, 28 are advantageously separated by a separation wall 46 that occupies a gap 48 between the magnet holder assemblies. The separation wall is made from a non-magnetic material and hermetically separates the first magnet holder assembly 26 from the second magnet holder assembly 28, thereby acting as a stationary seal for preventing leakage from the pumping chamber 14 out of the housing past the input shaft 20. As illustrated in FIG. 1, the separation wall 46 is provided with an axially extending flange 50 that partially encloses the second magnet holder assembly 28. The separation wall and flange may be made from non-magnetic steel and are arranged to be a press fit in the housing 12.

The amount of torque transmitted through the magnetic coupling 24 depends, e.g., on the size of the gap 48 between the first and second magnet holder assemblies. When the coupling is not rotating, the size of the gap 48 is determined by the thickness of the separation wall 46, the axial extension of the input shaft 20 beyond the end face of the magnets of the first magnet holder assembly 26, and the axial extension of the carrier shaft 30 beyond the end face of the magnets of the second magnet holder assembly 28. Due to the magnetic attraction between the first and second magnet holder assemblies, the first ends 21, 29 of the input shaft 20 and the carrier shaft 30, respectively, will contact the separation wall 46. Since the separation wall is stationary, it is advantageous if the ends 21, 29 of the input shaft and carrier shaft are rounded so that friction is reduced during rotation of the coupling. As a result of their magnetic attraction, the first and second magnet holder assemblies 26, 28 are inevitably drawn towards each other. Thus, the input shaft 20 and the carrier shaft 30 may be arranged to be axially displaceable relative to each other, thereby avoiding the need for close tolerances.

Accordingly, and as is schematically represented in FIG. 1, a first end stop 52 is located adjacent a second end 53 of the input shaft 20 remote from the separation wall 46, and a second end stop 54 is located adjacent a second end 55 of the carrier shaft 30 remote from the separation wall 46. The end walls are positioned such that when the first ends 21, 29 of the shafts 20, 30 contact the separation wall, there is free play between the end stops 52, 54 and the second ends 53, 55 of the shafts. Again, for reasons of friction, it is advantageous if the second ends 53, 55 of the shafts 20, 30 are rounded.

The rotary displacement pump 10 operates in the following manner.

When the pump is stationary, attraction between the magnets of the first and second magnet holder assemblies 26, 28 ensures that the first end 21 of the input shaft 20 and the first end 29 of the carrier shaft 30 contact the separation wall 46. As torque is applied to the gear wheel 22, the input shaft 20, and hence the first magnet holder assembly 26, rotate. The magnetic field between the first and second magnet holder assemblies causes the second magnet holder assembly 28, and hence the carrier shaft 30, to rotate. As a result, the driver rotor 16 rotates and drives the driven rotor 18 thereby pumping liquid through the pumping chamber 14.

When the torque across the coupling 24 reaches a certain value, the brake torque on the carrier shaft due to the pumping action of the driver and driven rotors becomes greater than the magnetic field strength between the first and second magnet holder assemblies. Thus, the second magnet holder assembly 28 starts to lag behind the first magnet holder assembly 26. When a certain angular amount of lag has been achieved, the actual amount being dependent on the geometry of the magnet holders 32, the magnets of the respective magnet holder assemblies begin to repel each other, thereby causing the input shaft 20 and the carrier shaft 30 to move away from each other. The extent to which the shafts part depends on the location of the end stops 52 and 54. Thus, the gap 48 between the first and second magnet holder assemblies increases and the amount of torque that the coupling is capable of transmitting is limited by the magnetic field strength attained at such separation. In this manner, it is ensured that the pumping pressure in the pumping chamber 14 never exceeds a desired level.

Figure 3:
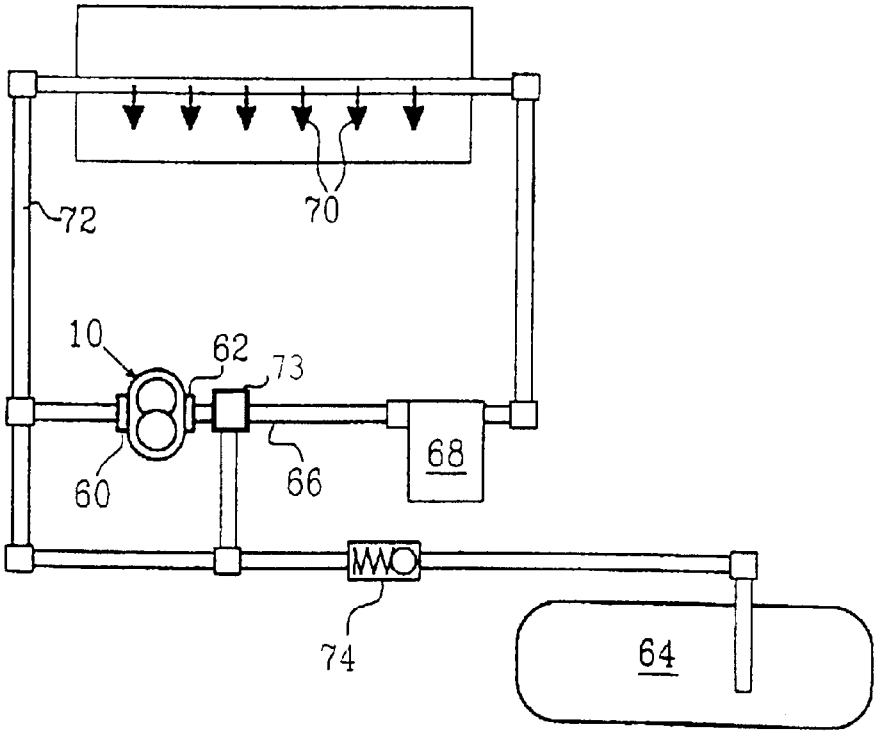
FIG. 3 is a schematic representation of a fuel delivery system according to the present invention.

The above-described pump is eminently suitable for use as a fuel pump in a vehicle fuel delivery system. Such a system is schematically illustrated in FIG. 3. In the drawing, the pump is denoted by reference numeral 10. The pump has a suction side 60 and an output side 62. The suction side 60 of the pump is connected to a fuel reservoir 64 and a fuel delivery line 66 is connected to the output side 62 of the pump. A fuel filter 68 is connected into the delivery line 66. Downstream from the fuel filter 68, a number of fuel injectors 70 are provided with fuel via the delivery line 66. In order to ensure that the fuel delivered to the injectors 70 has a substantially uniform temperature, the pump 10 is arranged to pump a greater quantity of fuel along the delivery line 66 than is required by the injectors 70. The fuel surplus is returned to the suction side 60 of the pump via a return line 72.

In accordance with the present invention, the magnetic coupling 24 of the pump 10 is arranged to slip when a predetermined value of torque is applied across the coupling 24 such that a maximum pressure value of about 12 bar, preferably about 9 bar, is attained at the output side 62 of the pump.

When a magnetic coupling slips, the torque transmission temporarily drops significantly. If the fuel delivery system of the present invention employed a pump with a magnetic coupling that restricted the pump output pressure only to a value corresponding to the operating pressure of the fuel injectors, there is a risk that the pressure would temporarily drop below this value when the coupling begins to slip. This could lead to temporary interruption of the fuel delivery. Thus, to avoid this problem, in a preferred embodiment of the invention the fuel delivery system further comprises a pressure relief valve 73 in the fuel delivery line 66 upstream of the fuel filter 68. The pressure relief valve 73 reduces the pressure in the fuel delivery line to about 6 bar, i.e., the normal operating pressure for the fuel injectors.

In a typical installation, the pump 10 can be arranged to pump between 2 and 8 liters/minute (l/min) of fuel at a maximum pressure of about 9 bar at the output side of the pump 10. As a result of the actions of the pressure relief valve 73, a pressure of about 6 bar is present in the fuel delivery line 66 downstream of the valve 73. Depending on the load on the engine, between about 0.5 and 1.5 l/min of fuel is injected into the engine via the injectors 70. This implies that between about 1.5 and 7.5 l/min of fuel is returned to the pump 10. An amount of fuel corresponding to that which has been injected into the engine is drawn from the reservoir 64 by the pump 10. A one-way valve 74 between the reservoir 64 and the pump 10 ensures that fuel in the return line 72 does not drain into the reservoir 64.

Since the magnetic coupling 24 in the pump 10 can be adapted to ensure that a maximum pressure of no more than 12 bar, preferably no more than 9 bar, is generated in the delivery line 66, even if the pressure relief valve 73 were to stick, the pressure in the delivery line 66 will never become so high that a risk of rupture of a component of the line arises. This further implies that less power is needed to drive the pump 10 than with conventional pumps that rely on a functioning pressure relief valve to restrict the maximum pressure in the fuel delivery system.

It is to be understood that the invention is not restricted to the embodiments described above and shown in the drawings, but may be varied within the scope of the appended claims. Thus, although the pump in the system according to the present invention has been illustrated as having axially separated magnet holder assemblies, it is to be understood that a pump having radially separated magnet holder assemblies may also be employed.

What is claimed is:

1. A fuel delivery system comprising:

a fuel reservoir connected to a suction side of a pump, a fuel delivery line connected to an output side of the pump, one or more fuel injectors connected to the fuel delivery line, and a return line from the one or more injectors to the suction side of the pump, wherein the pump further comprises a housing, a pumping chamber within the housing, a driver rotor and a driven rotor within the pumping chamber, and an input shaft to the housing, the input shaft being arranged so that rotation of the input shaft effects rotation of the driver rotor, the driver rotor rotatable by the input shaft via a magnetic coupling, wherein said magnetic coupling is arranged to slip when a predetermined value of torque is applied across the coupling such that a maximum pressure value of about 12 bar is attained at the output side of the pump, the magnetic coupling further comprising a first magnet holder assembly attached to the input shaft, and a second magnet holder assembly attached to a carrier shaft carrying the driver rotor, each magnet assembly comprising an annular magnet holder having a peripheral wall, an inner wall and at least three dividing walls extending radially from the inner wall to the outer wall to define a number of compartments, each compartment being adapted to house a pair of magnets.

2. The fuel delivery system as claimed in claim 1 wherein said magnetic coupling is arranged to slip such that a maximum pressure of about 9 bar is attained at said output side of said pump.

3. The fuel delivery system as claimed in claim 1, further comprising a pressure relief valve in said fuel delivery line, said pressure relief valve being arranged to reduce the pressure in said fuel delivery line to about 6 bar.

4. The fuel delivery system as claimed in claim 3, further comprising a fuel filter, wherein said fuel filter is provided in said delivery line downstream of said pressure relief valve.

5. The fuel delivery system as claimed in claim 1, each said magnet holder assembly further comprising a backing plate of magnetic material to which each said pair of magnets is adhered.

6. The fuel delivery system as claimed in claim 1, wherein said magnetic holder is made of aluminum.

* * * * *

UNITED STATES PATENT AND TRADEMARK OFFICE

CERTIFICATE OF CORRECTION

PATENT NO. : 6,539,926 B2 
DATED : April 1, 2003
INVENTOR(S) : Nils-Olof Hakansson et al.

It is certified that error appears in the above-identified patent and that said Letters Patent is hereby corrected as shown below:

Title page,
Item [73], Assignee, should read: -- Volvo Lastvagnar AB, Goteborg, Sweden (SE). --

Signed and Sealed this

Fifth Day of August, 2003

JAMES E. ROGAN
*Director of the United States Patent and Trademark Office*